US011024997B2

(12) United States Patent
Wittmann

(10) Patent No.: US 11,024,997 B2
(45) Date of Patent: Jun. 1, 2021

(54) ELECTRICAL CONNECTOR SYSTEM WITH VIBRATION PREVENTION

(71) Applicant: Robert Bosch GmbH, Stuttgart (DE)

(72) Inventor: Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/634,949

(22) PCT Filed: Jul. 31, 2018

(86) PCT No.: PCT/EP2018/070668
§ 371 (c)(1),
(2) Date: Jan. 29, 2020

(87) PCT Pub. No.: WO2019/025402
PCT Pub. Date: Feb. 7, 2019

(65) Prior Publication Data

US 2020/0243996 A1 Jul. 30, 2020

(30) Foreign Application Priority Data

Jul. 31, 2017 (DE) ..... 10 2017 213 150.0

(51) Int. Cl.
*H01R 13/11* (2006.01)

(52) U.S. Cl.
CPC ..... *H01R 13/113* (2013.01); *H01R 13/111* (2013.01)

(58) Field of Classification Search
CPC ... H01R 13/14; H01R 13/631; H01R 13/6315
(Continued)

(56) References Cited

U.S. PATENT DOCUMENTS 2,497,568 A * 2/1950 Thacker ..... H01R 13/18 439/252
3,019,410 A * 1/1962 Logan ..... H01R 13/025 439/848

(Continued)

FOREIGN PATENT DOCUMENTS

CN 1433107 A 7/2003
CN 1502450 A 6/2004

(Continued)

OTHER PUBLICATIONS

International Search Report for PCT/EP2018/070668, dated Oct. 5, 2018.

*Primary Examiner* — Neil Abrams
(74) *Attorney, Agent, or Firm* — Norton Rose Fulbright US LLP; Gerard Messina

(57) ABSTRACT

An electrical plug contact for high-current applications. The plug contact encompasses a housing that extends along a longitudinal axis and an interior space for receiving a single counterpart contact element. The plug contact encompasses a cable having a plurality of strands, the cable being guided from an exterior space of the housing into the interior space and being fastened thereon. The cable has an end in the interior space, the cable having, adjacently to the end, a damping portion in which the cable is split into a plurality of separate conductors; a plurality of contacting elements, each of which is arranged suitable for electrically and mechanically contacting the single counterpart contact element, each of which is secured on a corresponding one of at least two of the conductor strands, so that each conductor strand is connected to one contact element, and so that each conductor strand is at the same electrical potential.

13 Claims, 5 Drawing Sheets

(58) Field of Classification Search
USPC ..... 439/252, 246, 251; 385/385, 857
See application file for complete search history.

(56) References Cited

U.S. PATENT DOCUMENTS

| | | | | | |
|---|---|---|---|---|---|
| 3,133,780 | A * | 5/1964 | Dean | H01R 12/721 | 439/857 |
| 3,594,697 | A * | 7/1971 | Azbell | H01R 4/52 | 439/251 |
| 3,778,748 | A * | 12/1973 | Holman | H02G 5/08 | 439/251 |
| 3,964,814 | A * | 6/1976 | Kalbitz | H01F 27/40 | 439/248 |
| 4,025,145 | A * | 5/1977 | Shaffer | H01R 9/032 | 439/607.52 |
| 5,399,808 | A * | 3/1995 | Carter | H02G 15/1806 | 174/36 |
| 5,611,717 | A * | 3/1997 | Joly | H01R 13/14 | 439/252 |
| 5,649,837 | A * | 7/1997 | Arnold | H01R 13/6315 | 439/247 |
| 5,791,939 | A * | 8/1998 | Tanigawa | H01R 9/0518 | 439/607.01 |
| 5,951,314 | A * | 9/1999 | Durand-Cochet | H01R 13/187 | 439/252 |
| 6,186,810 | B1 * | 2/2001 | Barnabe | H01R 13/187 | 439/252 |
| 6,709,253 | B2 * | 3/2004 | Hattori | H01R 13/5205 | 249/95 |
| 6,921,862 | B2 * | 7/2005 | Bach | H02B 1/21 | 174/149 B |
| 8,585,421 | B2 * | 11/2013 | Yamaguchi | H01R 13/05 | 439/248 |
| 9,112,397 | B2 * | 8/2015 | Kobayashi | H01R 9/24 | |
| 9,806,449 | B2 * | 10/2017 | Hachadorian | H01R 13/111 | |
| 2004/0029457 | A1 * | 2/2004 | Jourdan | H01R 13/113 | 439/894 |
| 2020/0243996 | A1 * | 7/2020 | Wittmann | H01R 13/533 | |

FOREIGN PATENT DOCUMENTS

| | | | |
|---|---|---|---|
| CN | 103779721 | A | 5/2014 |
| DE | 1075694 | B | 2/1960 |
| DE | 10107234 | C1 | 6/2002 |
| DE | 10138755 | A1 | 2/2003 |
| DE | 102009012726 | A1 | 9/2010 |
| DE | 102011076988 | A1 | 12/2012 |
| EP | 276895 | A1 | 8/1988 |
| EP | 0926766 | A1 | 6/1999 |
| GB | 2353415 | A | 2/2001 |
| JP | 2008218380 | A | 9/2008 |
| WO | 0112377 | A1 | 2/2001 |
| WO | 2016069570 | A2 | 5/2016 |

* cited by examiner

FIG. 3a
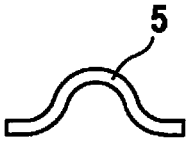
FIG. 3b
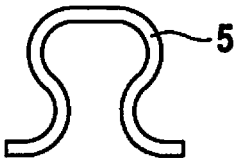
FIG. 3c
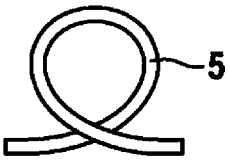
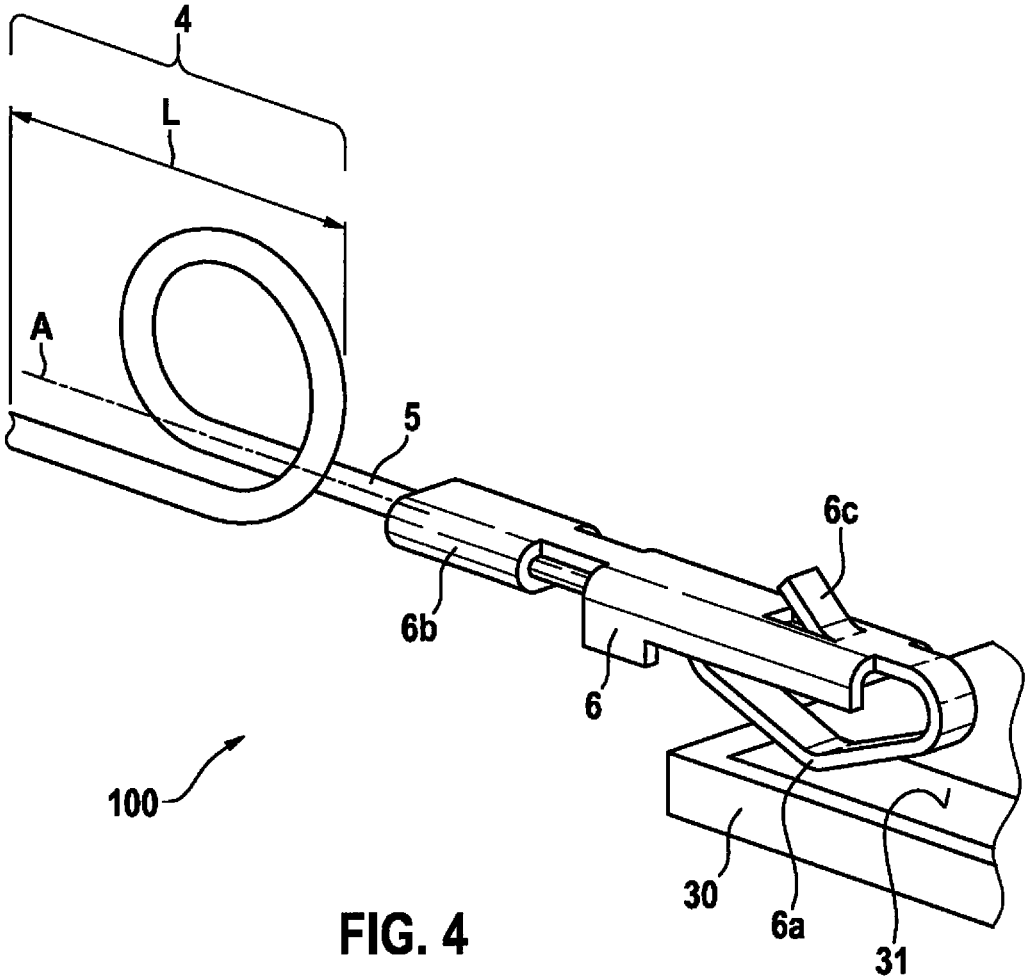
FIG. 4

ELECTRICAL CONNECTOR SYSTEM WITH VIBRATION PREVENTION

FIELD OF THE INVENTION

The present invention relates to an electrical plug contact for high-current applications. The invention further relates to a plug connector system for high-current applications.

BACKGROUND INFORMATION

Plug connectors with which very high currents (up to approx. 300 A) must be transferred are required in highly electrified motor vehicles (electric or hybrid vehicles). At such currents, even small increases in contact resistance become apparent by way of high power dissipation, which results in high thermal stress on the plug. Stringent requirements therefore exist in terms of contact stability even under the severe vibration loads that occur in a vehicle.

The vibrations introduced into the plug connector through the cable can be attenuated, and the contact points that are subject to service life-limiting frictional wear can thus be protected, by a damping element contained in the socket contact.

Patent document DE 101 38 755 discusses a contact in which the damping element is made up of a serpentine portion of the stamped bent part that constitutes the current-carrying element of the socket contact.

Patent document EP 0 926 766 discusses a contact in which the damping element is made up of a flexible mesh.

Patent document DE 10 2011 076988 discusses contacts that are not embodied as a socket but instead have a contact leaf that protrudes to one side and directly contacts a conductive countermember. Such contacts are known as "direct contacts."

SUMMARY OF THE INVENTION

The present invention proceeds from the recognition that with the cable cross sections of several square millimeters ($mm^2$) that are used to transfer the high currents, considerable vibrational loads are introduced into the contact and can only be absorbed by a single damping element if the latter is very finely divided and flexurally elastic. At the same time, however, it must transfer the high currents ($I >> 10$ A) with little electrical resistance, and must therefore itself have a large conductor cross section and short length. This represents a conflict in objectives for the finely divided mechanical configuration.

A need can therefore exist for furnishing a plug contact and a plug connector system in which the plug contact is designed to reliably damp the vibrational loads that occur, and thereby increase service life, without impairing current capacity. At the same time, the plug contact is intended to be simple and economical to manufacture.

This need can be met by the subject matter of the present invention in accordance with the descriptions herein. Advantageous embodiments of the present invention are described in the further descriptions herein.

In the context of the invention, the terms "encompass" and "have" are used synonymously unless expressly indicated otherwise.

According to a first aspect of the invention, an electrical plug contact for high-current applications is proposed. The plug contact encompasses a housing that extends along a longitudinal axis and has an interior space for reception of a counterpart contact element. The plug contact furthermore encompasses a cable that is constituted from a plurality of strands, the cable being guided from an exterior space of the housing into the interior space of the housing and being fastened on the housing. The cable has an end in the interior space, the cable having, adjacently to the end, a damping portion in which the cable is split into a plurality of separate conductors, a contacting element being secured on at least two conductors. The contacting elements are suitable in particular for electrical and mechanical contacting of the counterpart contact element, each of which is secured on a corresponding one of at least two of the conductor strands, so that each conductor strand is connected to one contact element. Advantageously, a corresponding contacting element is fastened on each of the at least two conductors.

In other words, provision is made to divide the electrical conduction path, which is constituted by the cable with its strands, into a larger number of individual paths within the plug connector which can each mutually independently be damped in terms of vibration. This is achieved by the fact that the cable, which can have a large cross section because of the high current capacity, is unbraided into several conductors, and the damping element is thus constituted from the separated conductors. The free ends of the conductors are then connected to individual contacting elements that mutually independently contact the counterpart contact. In particular, several contacting elements are provided, which may be one contacting element per conductor.

As a result of the division of the electrical conduction path into many smaller ones connected in parallel, the conflict of objectives between flexible mechanical design and high current capacity is advantageously mitigated. Optimal mechanical decoupling of the individual contacting elements from one another is further ensured.

All in all, considerably better vibration damping along with high current capacity are advantageously ensured by the proposed plug contact. Furthermore, no additional elements specifically for vibration damping are required, but instead the constituents of the cable as such are sufficient. Vibration damping of the plug contact can thus be effected in a particularly simple and inexpensive manner.

A "plurality of elements" is to be understood for purposes of this Application as at least two elements.

Contacting elements may be connected to at least most of the conductors. Very particularly, contacting elements may be connected to all conductors. The contacting elements can be elements that are initially separate from the cable and from the conductors. They can be fastened on the conductors, for example, by way of a crimped connection or by way of an intermaterial connection, for example a welded connection or a soldered connection.

The contacting elements can be manufactured, for example, from sheet metal as stamped bent parts. They can have, for example, a resilient element and/or a kind of contact leaf which faces, for example, in a radial direction, i.e. in a direction perpendicular to the longitudinal axis, toward the contact surface of the counterpart contact element that is to be inserted.

The contacting element can also have a latching element, for example in the form of a latching tip that protrudes obliquely outward and is deflectable elastically reversibly inward. A latching element of this kind can latch, for example, in the housing of the plug contact on an undercut, and can thereby retain the contacting element against being pulled out of the housing oppositely to an insertion direction.

Alternatively, a latching tip of this kind can also be embodied, for example, from plastic, for instance as part of the plug connector housing, and can engage into a latching geometry on the contact.

The current-carrying cable can be fixedly attached to the housing or to a wall of the housing. It can be advantageous to implement a maximally strong attachment. As a result, the vibrations introduced through the attachment can be particularly effectively dissipated via the housing.

The cable can advantageously have, at least outside the housing of the plug contact, i.e. in the exterior space, an insulator or an insulating sheath that is constituted, for example, from a plastic and does not conduct electrical current well. The insulator or insulating sheath can also be guided into the interior space of the housing.

The current-guiding parts of the cable, in particular the plurality of strands, can be constituted from a material that conducts electrical current very well and encompasses, for example, copper, aluminum, or alloys of those materials.

The counterpart contact element to be inserted into the plug contact usually has a radially outward-facing surface (its contact surface) that encompasses a material from the group of silver, gold, tin, nickel, or alloys of the aforesaid materials.

It is understood that the strands can also be coated, e.g. tinned.

Particularly good vibration damping is advantageously brought about by the fact that a length along which conductor strands 5 extend in damping portion 4 is at least 20% greater than a length L of damping portion 4 along longitudinal axis A.

The damping portion can extend between that end of the contacting element which faces toward the conductor, and the stripped part of the cable. If the stripped cable is not yet unwoven into individual conductors over a longer section, the damping portion then extends between that end of the contacting element which faces toward the conductor, and that point on the cable at which the individual conductors are guided separately.

The advantageous result of the fact that the cable has an electrically conductive cross section of at least 10 $mm^2$ is that the cable has a high current capacity of at least 10 A, which may be at least 50 A, and very particularly may be at least 150 A. Advantageously, the cable has an electrically conductive cross section of at least 50 $mm^2$. The cross section can be determined, for example, perpendicularly to the longitudinal axis.

Particularly high current capacity for the conductors, and high mechanical stability for the individual conductor, are achieved because each conductive lead is constituted from several strands.

The fact that each conductor has a cross section of at least 0.2 $mm^2$, and at most 6 $mm^2$, advantageously results in particularly good flexibility for the individual conductors, producing particularly good vibration damping. At the same time, each conductor as a result has sufficient mechanical stability and current capacity, and a contact element can be connected to it without difficulty. Particularly, the cross section of each conductor may be in a range from 0.5 $mm^2$ to 2 $mm^2$.

The advantageous result of the fact that the damping portion is disposed completely in the interior space of the housing is that the plug contact is of compact construction, and the risk of an undesired short circuit between two plug contacts, or of catching between two plug contacts, remains low. In other words, the housing surrounds the damping portion and encloses it.

Particularly good damping of vibrations is advantageously brought about by the fact that the conductors in the damping portion extend along a shape that is selected from the group of an arc, an omega shape, a loop. Particularly good damping in a small space, or a short length for the damping portion extending along the longitudinal axis, can be achieved by way of the proposed shapes. As a result, the plug contact can advantageously be configured to be particularly compact and small. This is a great advantage, for example, for confined space conditions in automobiles or other technical devices.

Particularly reliable electrical and mechanical contacting of the contact surfaces of the counterpart contact element is advantageously ensured by the fact that the contacting elements are disposed along a circle around an axis, the axis extending parallel to the longitudinal axis (A). A counterpart contact element inserted into a contact element embodied in this manner automatically becomes centered by the contacting elements in a radial direction, i.e. transversely to the longitudinal axis. If the counterpart contact element becomes shifted in a radial direction by vibration, the contact pressure on one of the contacting elements might be reduced, but at the same time the contact pressure on the oppositely located contacting element then increases. Reliable electrical contact between the contact element and the counterpart contact element is thereby ensured.

According to a second aspect of the invention, a plug connector system, in particular for high-current applications, is proposed.

The plug connector system encompasses an electrical plug contact as described above. The plug connector system further encompasses a counterpart contact element. The counterpart contact element is contacted mechanically and electrically to the contacting elements.

The advantageous result is to create a plug connector system that simultaneously exhibits particularly good vibration damping and high current capacity of more than 10 A, which may be of more than 50 A, and can be manufactured simply and inexpensively with only a few elements.

The counterpart contact element can have, for example on its radially outward-facing outer side, at least one material that is selected from the group of silver, gold, tin, nickel, or alloys of the aforesaid materials. This makes possible a particularly high current capacity and, when noble metals are used, particularly good corrosion resistance. Particularly low contact resistance can also be brought about thereby.

Because the counterpart contact element has a round cross section, the counterpart contact element is particularly simple to manufacture and can be inserted in a particularly simple manner into the plug contact or its housing, since there is no preferred direction in a circumferential direction around the longitudinal axis. It can also be contacted in a particularly simple manner as a result. It can thus be embodied as a "round pin."

The counterpart contact element can be inserted into the housing of the plug contact, for example, in an insertion direction.

The interior space of the housing can correspondingly have a circular cross section. Particularly simple manufacture of the plug contact is thereby advantageously made possible. The result is that the counterpart contact element is particularly easy to insert.

Particularly reliable and cost-effective vibration decoupling can be furnished thanks to the fact that the counterpart contact element is embodied as a flat blade and the plug contact is embodied to be slid onto the flat blade, the contacting element being capable of electrically and mechanically contacting contact surfaces of the flat blade, including for contacting and/or decontacting of multipoint connector contacts embodied as flat blades.

Such contacting can be furnished by a single respective contacting element for each flat blade. In this case the flat blade is electrically contacted only from one side. In the case of multiple flat blades of a multipoint connector, the electrical plug contact can have several contacting elements next to one another, each of which contacts a flat blade.

The electrical plug contact for contacting each flat blade can, however, also have, for example, two mutually oppositely located contacting elements between which the flat blade can then be inserted for contacting. In other words, with an embodiment of this kind there can be embodied between the mutually oppositely contacting elements a gap or a slot or a kind of duct, into which the flat blade of a multipoint connector is slid for electrical contacting. For contacting a plurality of flat blades of a multipoint connector, the plug contact can have a series of contacting elements located pairwise oppositely from one another.

Further features and advantages of the present invention are evident to one skilled in the art from the description below of exemplifying embodiments, which are nevertheless not to be regarded as limiting the invention, with reference to the appended drawings.

BRIEF DESCRIPTION OF THE DRAWINGS

FIGS. 3*a*, 3*b* and 3*c* show various embodiments of the layout of the cable in the damping portion.

FIG. 4 is a schematic detail view of the cable in a further embodiment of the plug contact.

DETAILED DESCRIPTION

Figure 1:
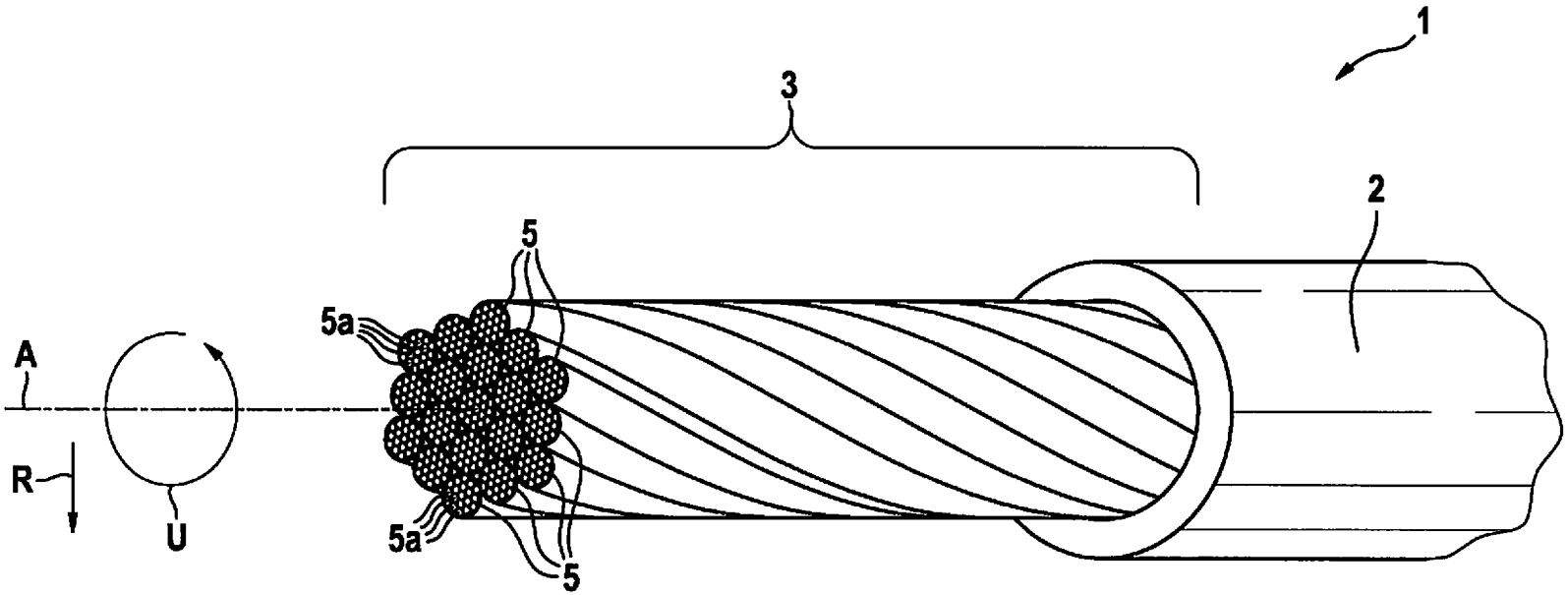
FIG. 1 is a perspective view of a cable of a plug contact.

FIG. 1 shows a cable 1 for an electrical plug contact for high-current applications, the cable extending along a longitudinal axis A. Cable 1 is constituted from a plurality of strands 5*a*. Several strands 5*a* are respectively bundled into a conductor 5. The cable is thus constituted from a plurality of conductors 5. Conductors 5 are, however, all in electrical and mechanical contact with a respective adjacent conductor 5, and are not guided separately from one another or spaced apart from one another. Because of this configuration, cable 1 is fairly flexurally stiff compared with separately guided conductors 5 or even individual strands 5*a*. On the other hand, it is more flexible than a cable that is constituted from a solid material. Cable 1 is very compact in a radial direction R that extends transversely to longitudinal axis A, and can therefore easily be encased in an insulator 2 that is embodied as an insulating sheath. Cable 1 also has a high current capacity thanks to the plurality of strands.

Strands 5*a* of cable 1 can encompass as material, for example, copper, aluminum, tin, silver, or alloys of those materials. The strands can also, for example, be coated, for example tinned. Insulator 2 can have an electrical conductivity that is at least two orders of magnitude lower than that of the strands. It can be constituted from a poorly electrically conducting plastic.

Cable 1 is configured to conduct high currents, for example at least 10 A, which may be at least 50 A, and very particularly may be at least 150 A. It can have for that purpose a cross section of, for example, at least 5 $mm^2$, which may be at least 10 $mm^2$, and very particularly may be at least 25 $mm^2$. For example, cable 1 can have a cross section of 25 $mm^2$ or 50 $mm^2$ or 100 $mm^2$.

Also depicted in the Figure is the circumferential direction U that proceeds around longitudinal axis A.

Figure 2A:
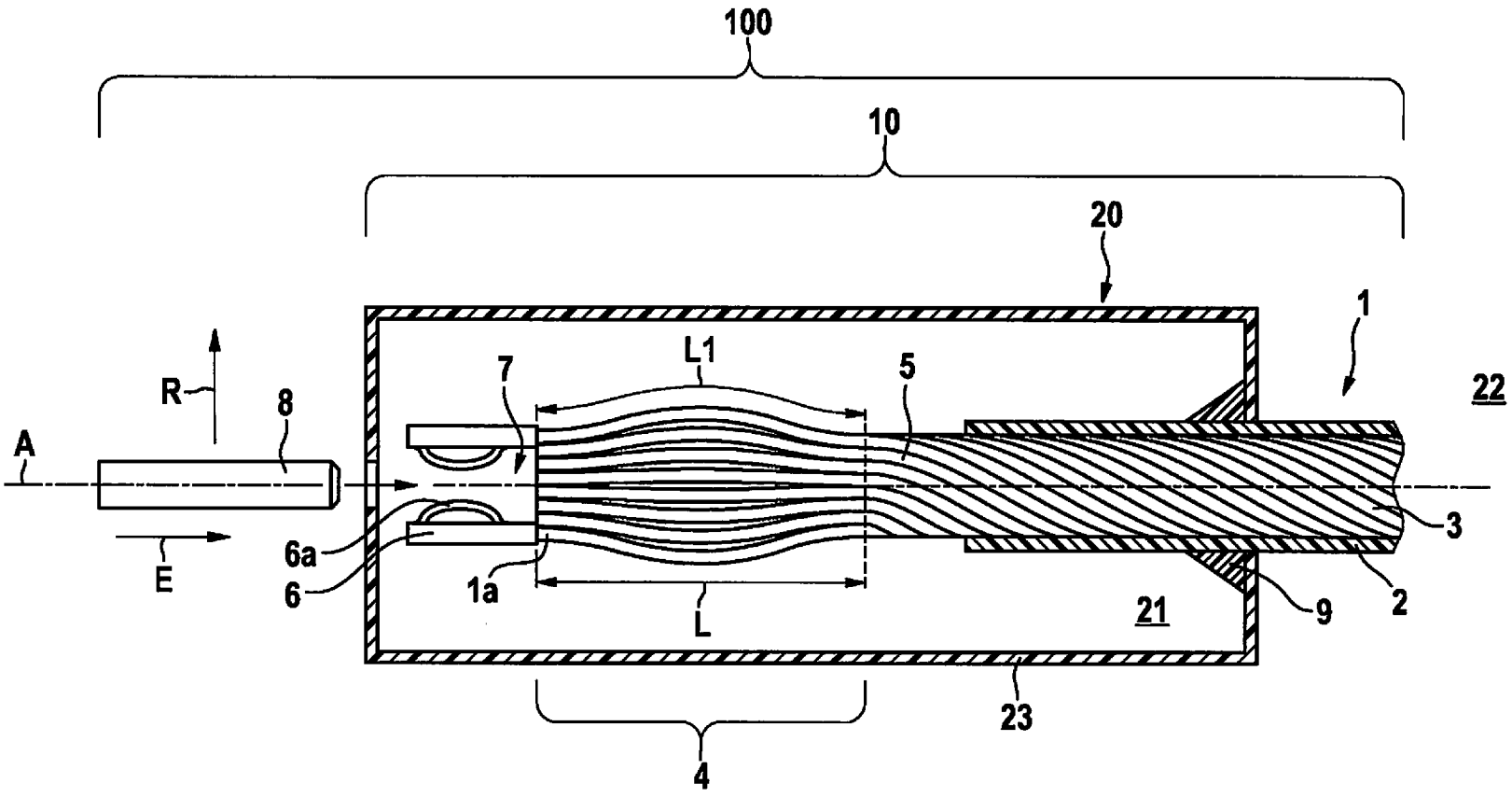
FIG. 2*a* is a schematic cross section of a plug contact.

FIG. 2*a* is a schematic cross section through a plug connector system 100 for high-current applications. Plug connector system 100 has an electrical plug contact 10 for high-current applications, as well as a counterpart contact element 8. Plug contact 10 encompasses a housing 20 that extends along a longitudinal axis A, and an interior space 21 for receiving counterpart contact element 8. An exterior space 22 of plug contact 10 is located outside plug contact 10. Interior space 21 can be delimited by a wall 23. Plug contact 10 further encompasses a cable 1 that can correspond at least in portions to cable 1 of FIG. 1. Like the one in FIG. 1, cable 1 is constituted from a plurality of strands 5*a*. Cable 1 is guided from exterior space 22 of housing 20 into interior space 21 of housing 20, and is fastened on housing 20. Fastening can be achieved with a usual fastening apparatus/device (arrangement) 9, for example clamps, coupling nuts, hose clamps, etc.

Cable 1 has an end 1*a* in interior space 21. Cable 1 has a damping portion 4 adjacent to end 1*a*. Cable 1 is split, in damping portion 4, into a plurality of separate conductors 5. In contrast to conductors 5 depicted in FIG. 1, conductors 5 of FIG. 2*a* in damping portion 4 are thus not located close together, and are not in mechanical and/or electrical contact with at least one adjacent conductor 5 along their length. They are instead separate from one another, and thus mechanically decoupled from one another at least in radial direction R. A contacting element 6 is secured on at least two conductors 5, so that each conductor strand is connected to one contact element. These contacting elements 6 are suitable for mechanically and electrically contacting counterpart contact element 8 in the state inserted into housing 20. Contacting elements 6 are disposed in housing 20 so as to face toward one another, and delimit a contacting space 7 into which counterpart contact element 8 can be slid. Contacting elements 6 have, on their surfaces facing toward contacting space 7, contact leaves 6*a* that can be embodied as resilient contact tabs and can come into mechanical and electrical contact with a contacting surface of counterpart contact element 8 as soon as the counterpart contact element is slid into contacting space 7. The contacting elements can be secured in their position in housing 20 with tight tolerances along longitudinal axis A, for example by way of a latching tip 6*c* (depicted in FIG. 4) that latches into interior space 21 of housing 20.

Vibrational decoupling of cable 1 is made possible by damping portion 4 which, in the exemplifying embodiment depicted, is disposed entirely in interior space 21 and is enclosed by housing 20. Damping portion 4 has a length L, along longitudinal axis A, which extends between that end of contacting elements 6 which faces toward damping portion 4, and the splitting of conductors 5 into mutually separate conductors 5. The conductors, conversely, have a length L1 in damping portion 4, along their respective directions of extent, which is at least 10% greater than length L of damping portion 4. Length L1 of conductors 5 may be at least 50% greater than the length of damping portion 4. Particularly good vibration damping, even at large amplitudes, is thereby produced.

Greater flexibility for cable 1 in damping portion 4 is achieved by the separation of conductors 5, with the result that vibrations cannot be transferred directly from contacting element 6 into cable 1, or from cable 1 to contacting elements 6.

In FIG. 2*a*, counterpart contact element 8 has not yet been inserted into housing 20 in an insertion direction E that here extends parallel to longitudinal axis A.

Figure 2B:
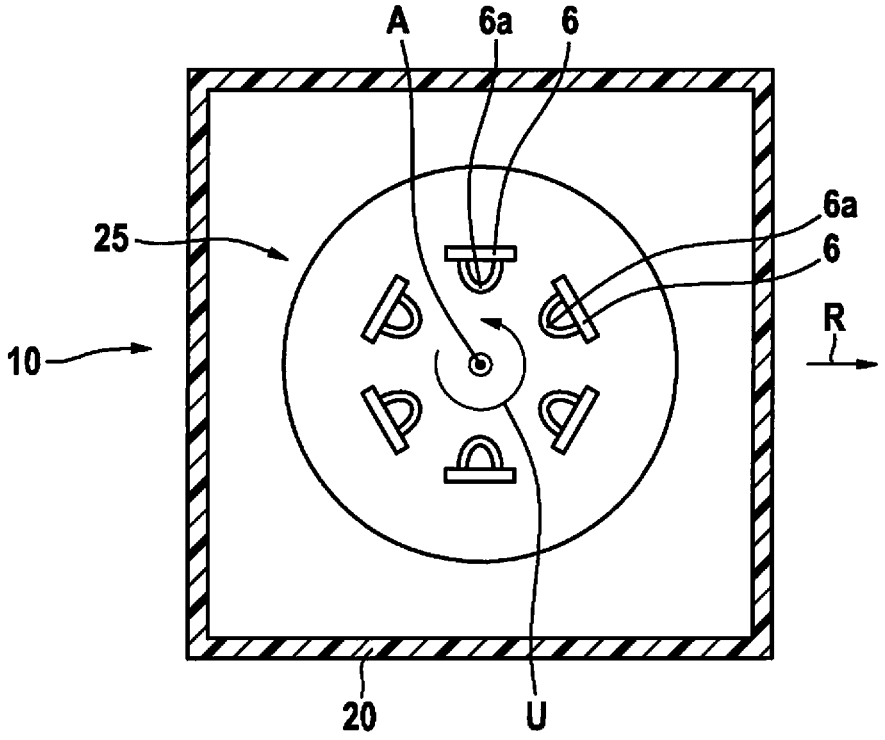
FIG. 2*b* is a frontal view of the plug contact of FIG. 2*a*.

FIG. 2*b* is a plan view of an insertion opening 25 for counterpart contact element 8 in housing 20. By way of example, six contacting elements 6 are depicted, with their contact leaves 6*a* facing toward contacting space 7. Contacting elements 6 are disposed on a circle that proceeds around an axis that extends parallel to longitudinal axis A.

Figure 2C:
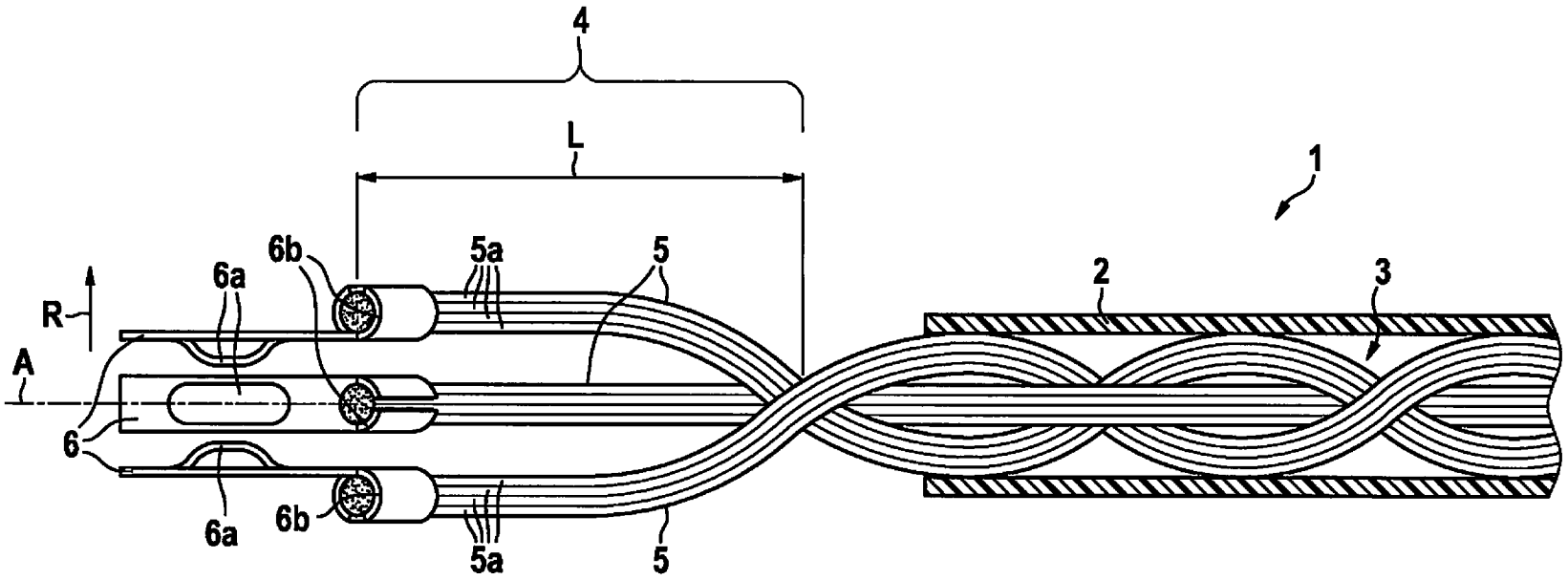
FIG. 2*c* is a schematic detail view of the cable from the plug contact of FIG. 2*a*.

FIG. 2*c* is a plan view of cable 1 in plug contact 10 of FIG. 2*a*. Depicted from right to left is the manner in which conductors 5 firstly proceed inside insulator 2 in an interwoven manner with one another. Conductors 5 then continue to proceed inside insulator 2, interwoven with one another as in FIG. 1, in a stripped portion. This is followed, lastly, by the damping portion, in which conductors 5 are unwoven, i.e. proceed separately from one another: here, they are mechanically decoupled from one another. Damping portion 4 is followed by contacting elements 6, which are each fastened, at a free end of a separate conductor 5, in a connecting portion 6*b* of contacting element 6. Conductor 5 can be, for example, crimped on in this connecting portion 6*b* (see FIG. 2*c*), but it can also be soldered on, welded on, or, for example, adhesively bonded on with a conductive adhesive.

The contacting elements can be produced, for example, from a thin or thicker metal sheet having a material thickness from 0.1 to 5 mm, which may be 1 mm to 3 mm. They can be embodied as stamped bent parts.

Counterpart contact element 8 can be embodied, for example, as a round element or contact blade. It can encompass aluminum or copper or silver as a material, or alloys of those substances. It can be coated on its external radial surface, for example, with a material that encompasses gold, silver, copper, platinum, tin, or alloys of those materials.

FIGS. 3*a* to 3*c* show various shapes in which the separated conductors 5 of cable 1 can proceed in the damping portion. FIG. 3*a* shows the shape of an arc. FIG. 3*b* shows an omega shape, and FIG. 3*c* shows a loop shape. These configurations allow a maximally long decoupling section or length L1 of the respective separated conductors 5 to be implemented over a short distance along longitudinal axis A. The damping effect with respect to vibrations can accordingly be improved.

FIG. 4 shows a plug connector system 100 in which counterpart contact element 8 is constituted by a flat blade 30 having a contact surface 31. In the interest of clarity, only a single contacting element 6 on a single separated conductor 5 is depicted here. Housing 20, which ensures that contacting element 6 becomes pressed against contacting surface 31 (similarly to an insertion slot for an SD card into an SD card reader), has also been omitted. Depicted on the left side of the Figure is damping portion 4, at whose end (farther to the right) contacting element 6 is, for example, crimped into connecting portion 6*b*. Contacting element 6 contacts, with its contact leaf 6*a*, contact surface 31 of the flat blade. Disposed by way of example on that side of contacting element 6 which faces away from contact leaf 6*a* is a latching tip 6*c*, deflectable elastically reversibly inward, which can latch into an undercut of housing 20 (not depicted here) of plug contact 10.

It is understood that in an embodiment that is not depicted here, flat blade 30 can also have a further contact surface on its side that faces away from contact surface 31 and faces downward in the Figure. Contacting can then be effected by way of an electrical plug contact 10 that is embodied like the one in FIG. 4 but has a further contacting element that is located opposite contacting element 6 and that electrically and mechanically contacts the further contact surface. There can be embodied, between contacting element 6 and the further contacting element, a gap or slot or duct into which flat blade 30 can be slid so that its contact surface 31, and the further contact surface, are electrically contacted respectively by contacting element 6 and by the further contacting element. Contacting element 6 and the further contacting element can be mechanically connected to one another in such a way that they clamp flat blade 30 between them and thereby always apply a sufficiently large contact force that acts on both sides of the flat blade.

An electrical plug contact 10 of this kind can also mutually contact several flat blades of a multipoint connector simultaneously. In that case, several pairs of mutually oppositely located contacting elements 6 and further contacting elements are then disposed in a row next to one another.

Vibration-damped direct contacting of flat blades, e.g. flat blades of a multipoint connector, can thereby be accomplished in a simple and cost-effective manner.

What is claimed is:

1. An electrical plug contact for a high-current application, comprising:

a housing that extends along a longitudinal axis and has an interior space for receiving a counterpart contact element;

a cable that is constituted from a plurality of conductor strands, the cable being guided from an exterior space of the housing into the interior space of the housing and being fastened on the housing, wherein the cable has an end in the interior space, and wherein the cable has, adjacently to the end, a damping portion in which the cable is split into a plurality of separate conductor strands; and a plurality of contacting elements, each of which is suitable for electrically and mechanically contacting the counterpart contact element, and each of which is secured on a corresponding one of at least two of the plurality of conductor strands, so that each of the conductor strands is connected to a corresponding contact element;

wherein each of the conductor strands of the cable are at the same electrical potential.

2. The electrical plug contact of claim 1, wherein a length along which the conductor strands extend in the damping portion is at least 20% greater than a length of the damping portion along the longitudinal axis.

3. The electrical plug contact of claim 1, wherein the cable has an electrically conductive cross section of at least 10 $mm^2$.

4. The electrical plug contact of claim 1, wherein each of the conductor strands is constituted from several strands.

5. The electrical plug contact of claim 1, wherein each conductor has a cross section of at least 0.2 $mm^2$ and at most 6 $mm^2$.

6. The electrical plug contact of claim 1, wherein the damping portion is disposed completely in the interior space of the housing.

7. The electrical plug contact of claim 1, wherein each of the conductor strands in the damping portion extend along a shape that is selected from one of an arc, an omega shape, and a loop.

8. The electrical plug contact of claim 1, wherein the contacting elements are disposed along a circle around an axis, the axis extending parallel to the longitudinal axis.

9. A plug connector system, comprising:

an electrical plug contact for a high-current application, including:

a housing that extends along a longitudinal axis and has an interior space for receiving a counterpart contact element;

a cable that is constituted from a plurality of conductor strands, the cable being guided from an exterior space of the housing into the interior space of the housing and being fastened on the housing, wherein the cable has an end in the interior space, and wherein the cable has, adjacently to the end, a damping portion in which the cable is split into a plurality of separate conductor strands; and a plurality of contacting elements, each of which is suitable for electrically and mechanically contacting the counterpart contact element, and each of which is secured on a corresponding one of at least two of the plurality of conductor strands, so that each of the conductor strands is connected to a corresponding contact element;

wherein each of the conductor strands of the cable are at the same electrical potential.

10. The plug connector system of claim 9, wherein the counterpart contact element has a round cross section; and/or wherein the counterpart contact element includes a flat blade and the plug contact is configured to be slidable onto the flat blade, the contacting element electrically and mechanically contacting contact surfaces of the flat blade.

11. The electrical plug contact of claim 1, wherein each of the contacting elements includes a contact leaf facing toward a contacting space, and wherein each of the contacting elements are each fastened, at a free end of one of the separate conductor strands, in a connecting portion of the contacting element.

12. The electrical plug contact of claim 11, wherein disposed on a side of the contacting element which faces away from the contact leaf is a latching tip, deflectable elastically reversibly inward, which latches into an undercut of the housing of the plug contact.

13. The electrical plug contact of claim 1, wherein the conductor strands are not in mechanical and/or electrical contact with at least one adjacent conductor strand along a length of the separate conductor.

* * * * *